US005475352A

United States Patent [19]

Hoffmann et al.

[11] Patent Number: 5,475,352

[45] Date of Patent: Dec. 12, 1995

[54] ARMATURE SUPPORT FOR A HINGED RELAY

[75] Inventors: Wolfgang Hoffmann; André Koerner, both of Lippstadt; Maik Zimmer, Erwitte, all of Germany

[73] Assignee: Hella KG Hueck & Co., Lippstadt, Germany

[21] Appl. No.: 259,678

[22] Filed: Jun. 13, 1994

[30] Foreign Application Priority Data

Jun. 23, 1993 [DE] Germany ..... 43 20 831.2

[51] Int. Cl.[6] ..... H01H 51/22

[52] U.S. Cl. ..... 335/78; 335/80; 335/128

[58] Field of Search ..... 335/86, 78–85, 335/124, 128, 131

[56] References Cited

U.S. PATENT DOCUMENTS 4,682,133 7/1987 Kern ..... 335/119

4,701,734 10/1987 Nakano et al. ..... 335/128

FOREIGN PATENT DOCUMENTS 7520638 1/1976 Germany .

3640737C2 6/1988 Germany .

*Primary Examiner*—Lincoln Donovan

*Attorney, Agent, or Firm*—Griffin, Butler, Whisenhunt & Kurtossy

[57] ABSTRACT

An armature support for a hinged relay has beveled bearing surfaces which force the armature, when the armature is displaced, into a rotational movement about a center of a switch contact. In this manner, structural tolerances of the hinged relay, as well as axial play in the armature support, are balanced out to avoid a switch contact displacement.

5 Claims, 2 Drawing Sheets

ARMATURE SUPPORT FOR A HINGED RELAY

BACKGROUND OF THE INVENTION

This invention concerns an armature support for hinged, or pivotal, relay comprising a yoke, or pole piece, an armature positioned at an end portion of the pole piece, and an armature holding spring which supports at least one switch contact and which is mechanically coupled to the armature.

With such a hinged relay an armature bears on at least two support points or also along a thin support edge of a pole piece at an end portion thereof.

The armature is held by an armature spring which is mechanically coupled thereto and which is coupled to the rest of the relay assembly at a suitable place.

When the armature is positioned in the area of the end portion of the pole piece, the armature has a certain axial play in a direction of its rotational axis.

This play can be reduced, with a corresponding expense, however it cannot be totally eliminated because this would lead to a fixed clamping of the hinged armature at its support positions.

This "position play" leads therefore, in known relays, to a displacement, or movement, of the armature along its support edge. It is thereby disadvantages that with this movement of the armature a movement of the armature holding spring also results so that a switch contact attached to the armature holding spring is no longer centered with its opposite contact, which is fixed relative to the rest of the relay assembly.

Thus, a contact is made which leads to a consumption of the switch contacts, however not in those areas where a particularly large consumption reserve has been provided for, but rather, mainly at edge areas of the switch contacts. A particularly quick consumption of the switch contacts caused in this manner can, by deforming the contacts, further lead to a blocking interference between the contacts.

A relative displacement of the contacts relative to one another thereby negatively affects a lifetime of such a hinged relay to a great extent and should, therefore, be avoided if possible.

In addition to this requisite play in the armature support, structural tolerances in a mounting of a relay can lead to a relative displacement of the switch contacts. In this manner, for example, during fabrication of a mechanical attachment between an armature holding spring and an armature, structural tolerances can lead to the armature holding spring being moved or rotated relative to a desired position on the armature. This also leads to a false positioning of the switch contact on the armature holding spring and to the disadvantages set forth above.

Because a minimizing of structural tolerances brings about a great increase in manufacturing costs, it is an object of this invention to provide an armature support for a hinged relay which is constructed in a particularly uncomplicated and cost effective manner so that a contact displacement during mounting and use of the relay is held small or completely eliminated if possible.

SUMMARY OF THE INVENTION

The object of this invention is solved in that, in an area at which an armature rests on a pole piece, the armature, or the pole piece, has beveled bearing surfaces.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 3:
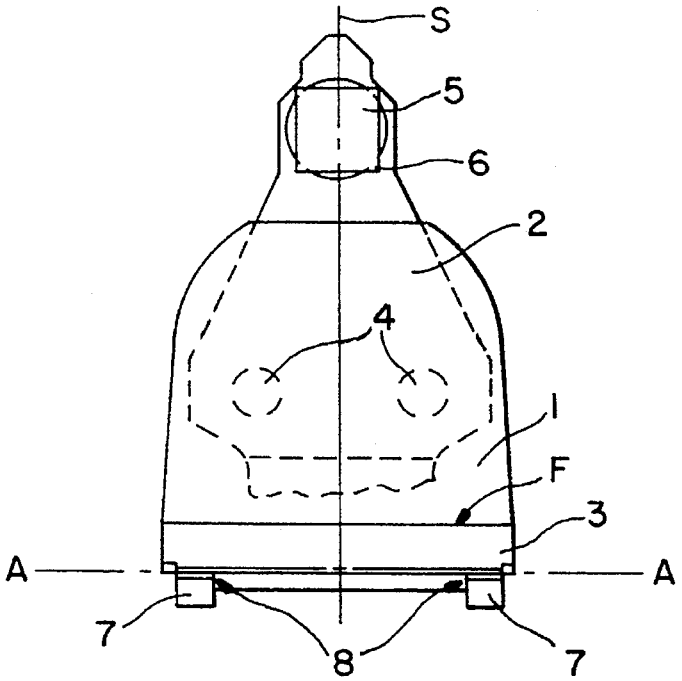
FIG. 3 PRIOR ART
FIG. 3 is a fragmented, partially cutaway, schematic view of a prior art armature support as seen looking at an armature holding spring in a direction of its desired switch contact movement.

First a prior art armature support is described using FIG. 3.

The armature support depicted in FIG. 3, which belongs to an otherwise not shown hinged armature relay, and which forms a thin-edge support for the armature 1, substantially comprises an armature 1 which bears against an end edge of a pole piece 3 and on which tongues, or protrusions, 7 are formed at the bearing area for engaging behind the end edge of the pole piece 3.

Additionally, in order to limit movement of the armature 1 along a rotation axis A, it can be provided that the pole piece 3, in the area of the armature 1 has recesses, which are not shown in the drawing, in which the protrusions 7 can engage.

Figure 4:
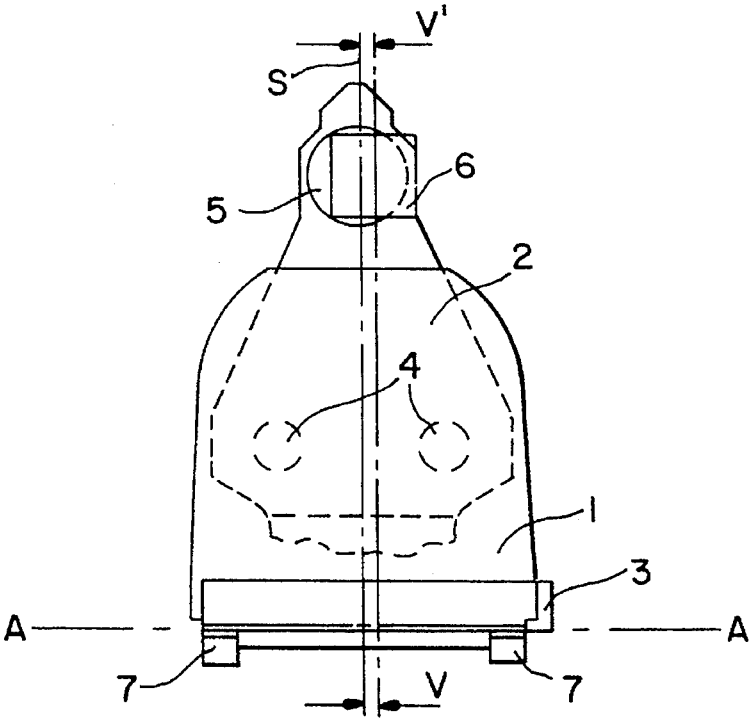
FIG. 4 PRIOR ART
FIG. 4 is a view similar to FIG. 3 but with an armature thereof being displaced along its rotational axis.

Because the armature support must have a certain axial play in the direction of the rotational axis of the armature 1, in each case a certain displacement V between the pole piece 3 and the armature 1 is possible, as is indicated in FIG. 4.

Since, in this regard, the armature 1 moves substantially parallel to the pole piece 3, a displacement V' of an identical size takes place between a switch contact 5 mounted on an armature holding spring 2 (in the drawing the position of the switch contact 5 is respectively indicated by a circular surface) and the oppositely positioned contact 6 (in the drawing this is represented by a rectangle).

Such a displacement between the switch contact 5 and the opposite contact 6 is in this prior art armature support unavoidable.

Further, component tolerances can, particularly during fabrication of a rivet connection 4 between the armature 1 and the armature holding spring for example, result in a rotation of the armature holding spring 2 relative to its desired position on the armature, which can result in additional displacement V' of the contacts 5, 6 relative to one another.

Figure 1:
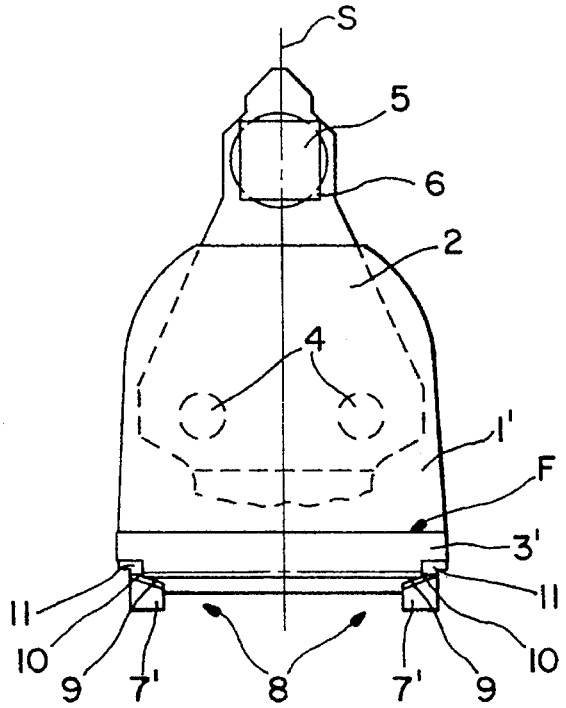
FIG. 1 is a fragmented, partially cutaway, schematic view of an armature support according to principles of this invention as seen looking at an armature holding spring in a direction of its desired switch contact movement.
Figure 2:
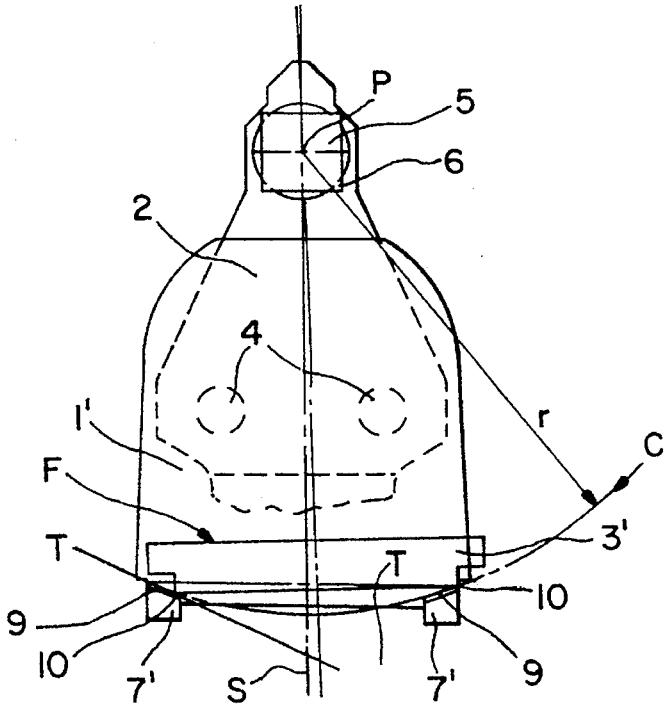
FIG. 2 is a view similar to FIG. 1 in which an armature thereof is displaced to the right.

FIGS. 1 and 2 depict a relay armature support according to principles of this invention to be compared therewith.

The structure of an armature 1', a pole piece 3', the armature holding spring 2, as well as the rivet coupling 4 between the armature holding spring 2 and the armature 1' corresponds substantially to that of the structure depicted in FIG. 3.

An important difference lies in the structure of the armature support. The tongues, or protrusions, 7' on the armature 1' have, relative to an end edge of the pole piece 3', beveled slanted or angled surfaces 9.

Respective corner edges 10 of the pole piece 3' respectively bear on these beveled surfaces 9. So that the width of the armature 1 must not be made to be too great, the width of the pole piece between the corner edges lying on the beveled surfaces 9 is reduced by recesses 11 in the pole piece 3'.

FIG. 1 shows the armature 1' arranged in an ideal position relative to the pole piece 3'. The armature 1' is arranged exactly at the middle of the pole piece 3', so that, as can be seen, the corner edges 10 of the pole piece 3' lie respectively in the middle of the beveled surfaces 9 of the armature 1'.

A symmetrical axis S of the armature 1 stands perpendicular to, and centered on, a surface F of the pole piece 3.

Such an ideal positioning of the armature 1' and the pole piece 3' relative to one another in practice is seldom achieved because of structural tolerances and play of the armature support.

Instead, normally, there is a displacement between the armature 1' and the pole piece 3'. Such a movement, or displacement, is represented in FIG. 2. In this regard, the armature 1' is displaced to the left relative to the pole piece 3'.

Because of this, the pole piece corner edges 10 no longer lie in the middles, but rather at the respective right end portions of the beveled bearing surfaces of the armature 1'. It can be seen in FIG. 2 that the symmetrical axis S of the armature 1' stands no longer perpendicular to the pole piece surface F and that the armature 1', because of the displacement of the armature bearing points, has taken on a slanted orientation relative to the pole piece 3'.

Preferably, the slanted, or beveled surfaces 9 of the armature 1' are formed such that a movement of the bearing points between the corner edges 10 of the pole piece 3' and the beveled bearing surfaces of the armature 1' bring about a rotational movement of the armature 1' about a contact center P. To do this the beveled, or slanted, bearing surfaces are beveled, or slanted relative to the rotational axis A and the symmetrical axis S.

This is the case if the beveled surfaces 9 correspond with, or lie on, a circular arc C whose radius r is the same as a spacing between the contact center point P and the touching, or bearing, points of the corner edges 10 of the pole piece 3' and the beveled bearing surfaces 9 of the armature 1'.

Because the beveled surfaces have very small dimensions relative to the radius r, the positions on the beveled surfaces 9 approach those of the circular arc C even though they correspond to tangents of the circular arc C.

Because such a tangential surface has no curvature, it can be quite easily formed from a technical, manufacturing point of view.

A particular benefit of such an arrangement of the beveled surfaces 9 is that a rotational moment is forced on the armature 1' when it is displaced relative to the pole piece 3' by the support, with a rotational center thereof being coaxial with a center P of the switch contact 5. In this manner the switch contact 5 does indeed experience a rotation about its center P, however, it does not experience a lateral movement relative to its opposite contact 6 so that adjustment and centering of the switch contact 5 and the opposite contact 6 is maintained. A switch contact relative lateral displacement is in this manner effectively eliminated, which, as is already discussed, has a positive effect on the life expectancy of the contacts and thereby on the entire relay.

An even more important benefit is that, with this inventive arrangement, manufacturing tolerances, particularly when joining the armature 1' and the armature holding spring 2, cannot have a negative effect on the positioning of the contacts relative to one another.

After the armature 1' and the armature holding spring 2 have been joined, particularly with a rivet junction 4, it is quite possible that the symmetrical axes of the armature 1' and the armature holding spring 2 are moved or rotated relative to one another.

Upon fabrication of the relay, the armature holding spring 2 is normally fixed at a position on the relay assembly, so that the switch contact 5 coupled to the armature holding spring 2 is positioned opposite contact 6. When there is an improper positioning between the armature 1' and the armature holding spring 2 the armature holding spring 2 can itself be in a correct position while, however, the armature 1', which is coupled to the armature holding spring 2, is not. With the inventive arrangement of this armature support the armature now has proper support on the beveled surfaces 9 in spite of the improper orientation caused by the armature holding spring 2.

According to the basic idea of this invention for providing a constraining guide for an armature which allows a movement of the armature only along a circular path with a predetermined radius r, it is possible to form beveled surfaces on a pole piece which side corners of the armature engage. It appears, however, if this is done, increased friction in the bearing area of the armature will appear and that, additionally, a magnetic coupling between the pole piece and the armature, relative to the preferred embodiment, is not as good so that the arrangement depicted in FIGS. 1 and 2 can be viewed as a preferred and particularly beneficial embodiment.

By arranging the support with beveled surfaces it is possible to substantially transfer a movement of the armature along its rotational axis into a rotational movement of the armature about a predetermined rotational center. In this manner it is particular beneficial to arrange the beveled surfaces so that they lie along a circular arc whose center is the switch contact center and whose radius correspond to a spacing from the switch contact center to the bearing points of the armature and the pole piece. In this manner it can be achieved that when the armature is moved lengthwise to the support (in a range of support play) the armature automatically rotates so that the switch contact, which is coupled to the armature by the armature holding spring, only experiences a rotational movement about its own center, however no lateral movement.

When manufacturing the beveled surfaces, it represents, from a technical manufacturing point of view, a beneficial simplification for the beveled surfaces to be shaped tangential to the circular arc, rather than exactly along the circular arc.

Although this invention has been described relative to a preferred embodiment, it would be possible to change various elements thereof while remaining within the spirit and scope of the invention.

The embodiments of the invention in which an exclusive property or privilege are claimed are defined as follows:

1. An armature support for a hinged relay comprising a pole piece, an armature positioned at an end of the pole piece, and an armature holding spring having at least one switch contact thereon which is mechanically coupled to the armature, wherein one of the pole piece and the armature has beveled bearing surfaces in a bearing area between the armature and the pole piece which are beveled relative to a rotational axis and a symetrical axis of the armature.

2. An armature support as in claim 1 wherein the beveled bearing surfaces extend along portions of a circular arc whose radius corresponds to a spacing between a center of the switch contact and armature corner edges.

3. An armature support as in claim 1 wherein the beveled bearing surfaces extend tangential to a circular arc whose radius corresponds to a spacing between a switch contact center and armature bearing positions.

4. An armature support as in claim 1 wherein protrusions on the armature form the beveled bearing surfaces.

5. An armature support as in claim 1 wherein a mechanical coupling between the armature holding spring and the armature comprises at least one rivet connection.

* * * * *